US010316266B2

(12) United States Patent
Waynick

(10) Patent No.: US 10,316,266 B2
(45) **Date of Patent: *Jun. 11, 2019**

(54) CALCIUM HYDROXYAPATITE BASED CALCIUM SULFONATE GREASE COMPOSITIONS AND METHOD OF MANUFACTURE

(71) Applicant: NCH Corporation, Irving, TX (US)

(72) Inventor: J. Andrew Waynick, Lantana, TX (US)

(73) Assignee: NCH CORPORATION, Irving, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/256,922

(22) Filed: Sep. 6, 2016

(65) Prior Publication Data

US 2016/0369198 A1 Dec. 22, 2016

Related U.S. Application Data

(63) Continuation of application No. 13/664,768, filed on Oct. 31, 2012, now Pat. No. 9,458,406.

(60) Provisional application No. 61/553,674, filed on Oct. 31, 2011.

(51) Int. Cl.

| | |
|---|---|
| ***C10M 169/00*** | (2006.01) |
| ***C10M 169/04*** | (2006.01) |
| ***C10M 141/10*** | (2006.01) |
| ***C10M 159/24*** | (2006.01) |
| ***C10M 135/10*** | (2006.01) |
| ***C10M 125/24*** | (2006.01) |
| ***C10M 169/06*** | (2006.01) |
| *C10N 10/04* | (2006.01) |
| *C10N 30/02* | (2006.01) |

(52) U.S. Cl.

CPC ..... *C10M 135/10* (2013.01); *C10M 125/24* (2013.01); *C10M 169/04* (2013.01); *C10M 169/06* (2013.01); *C10M 2201/085* (2013.01); *C10M 2201/0856* (2013.01); *C10M 2219/046* (2013.01); *C10M 2219/0466* (2013.01); *C10N 2010/04* (2013.01); *C10N 2030/02* (2013.01); *C10N 2230/02* (2013.01); *C10N 2230/08* (2013.01); *C10N 2250/10* (2013.01); *C10N 2270/00* (2013.01)

(58) Field of Classification Search

CPC . C10M 125/10; C10M 133/08; C10M 133/06
USPC ..... 508/162, 336, 391, 161, 144
See application file for complete search history.

(56) References Cited

U.S. PATENT DOCUMENTS

| | | | |
|---|---|---|---|
| 2,270,577 | A | 1/1942 | Bergstrom et al. |
| 2,402,325 | A | 6/1946 | Griesinger et al. |
| 2,418,894 | A | 4/1947 | McNab et al. |
| 2,444,970 | A | 7/1948 | Zimmer et al. |
| 2,485,861 | A | 10/1949 | Campbell et al. |
| 2,501,731 | A | 3/1950 | Mertes |
| 2,535,101 | A | 12/1950 | Sproule et al. |
| 2,540,533 | A | 2/1951 | Kolfenbach et al. |
| 2,585,520 | A | 2/1952 | Van Ess et al. |
| 2,616,904 | A | 11/1952 | Asseff et al. |
| 2,616,905 | A | 11/1952 | Asseff et al. |
| 2,616,906 | A | 11/1952 | Asseff et al. |
| 2,616,911 | A | 11/1952 | Asseff et al. |
| 2,616,924 | A | 11/1952 | Asseff et al. |
| 2,616,925 | A | 11/1952 | Asseff et al. |
| 2,617,049 | A | 11/1952 | Asseff et al. |
| 2,695,910 | A | 11/1954 | Asseff et al. |
| 2,723,235 | A | 11/1955 | Asseff et al. |
| 2,839,470 | A | 6/1958 | Warren et al. |
| 2,861,951 | A | 11/1958 | Carlyle |
| 2,865,956 | A | 12/1958 | Ellis et al. |
| 2,898,296 | A | 8/1959 | Pattenden et al. |
| 2,920,105 | A | 1/1960 | Kluge et al. |
| 2,937,991 | A | 5/1960 | Carlyle |
| 2,940,930 | A | 6/1960 | Pattenden et al. |
| 2,956,018 | A | 10/1960 | Carlyle et al. |

(Continued)

FOREIGN PATENT DOCUMENTS

| | | |
|---|---|---|
| CN | 101153239 | 4/2008 |
| CN | 101993767 | 3/2011 |

(Continued)

OTHER PUBLICATIONS

Kobylyanskli, E.V., Structure of Ultrabasic Sulfonate Greases:, Chem. and Tech. of Fuels and Oils, 2002, 38(2).

(Continued)

*Primary Examiner* — Prem C Singh
*Assistant Examiner* — Francis C Campanell
(74) *Attorney, Agent, or Firm* — Ross Barnes LLP; Robin L. Barnes

(57) ABSTRACT

An overbased calcium sulfonate grease composition comprising a reduced amount of overbased calcium sulfonate, calcium hydroxyapatite, base oil, one or more converting agents, and one or more complexing acids if a complex grease is desired. The calcium sulfonate grease composition improves thickener yield and expected high temperature utility as demonstrated by dropping point. A method of making the composition comprising the steps of mixing the calcium sulfonate and base oil, adding the calcium carbonate either before or after conversion, adding one or more converting agents, and adding one or more complexing acids. All or a portion of one or more of the complexing acids may be added with or prior to the one or more converting agents.

23 Claims, No Drawings

(56) References Cited

U.S. PATENT DOCUMENTS

| | | | |
|---|---|---|---|
| 2,967,151 | A | 1/1961 | Morway |
| 2,977,301 | A | 3/1961 | Bergen et al. |
| 2,978,410 | A | 4/1961 | Worth |
| 3,027,325 | A | 3/1962 | McMillen et al. |
| 3,057,896 | A | 10/1962 | Schlicht et al. |
| 3,150,088 | A | 9/1964 | Hunt et al. |
| 3,186,944 | A | 6/1965 | Dreher |
| 3,242,079 | A | 3/1966 | McMillen |
| 3,372,115 | A | 3/1968 | McMillen |
| 3,377,283 | A | 4/1968 | McMillen |
| 3,378,222 | A | 4/1968 | McMillen |
| 3,492,231 | A | 1/1970 | McMillen |
| 3,537,996 | A | 11/1970 | Holst et al. |
| 3,655,558 | A | 4/1972 | Geyer et al. |
| 3,661,622 | A | 5/1972 | Rogers |
| 3,671,012 | A | 6/1972 | Scott et al. |
| 3,679,584 | A | 7/1972 | Hellmuth |
| 3,681,242 | A | 8/1972 | Gilani et al. |
| 3,746,643 | A | 7/1973 | Rogers |
| 3,791,973 | A | 2/1974 | Gilani et al. |
| 3,816,310 | A | 6/1974 | Hunt |
| 3,850,823 | A | 11/1974 | Kjonaas |
| 3,907,691 | A | 9/1975 | King et al. |
| 3,929,650 | A | 12/1975 | King et al. |
| 3,940,339 | A | 2/1976 | Clarke, Jr. et al. |
| 4,297,227 | A | 10/1981 | Witte et al. |
| 4,378,060 | A | 6/1983 | Stadler |
| 4,435,299 | A | 3/1984 | Carley et al. |
| 4,444,669 | A | 4/1984 | Wittse, Jr. et al. |
| 4,483,775 | A | 11/1984 | Yamaguchi |
| 4,560,489 | A | 12/1985 | Muir et al. |
| 4,597,880 | A | 7/1986 | Eliades |
| 4,728,578 | A | 3/1988 | Higgins et al. |
| 4,744,920 | A | 5/1988 | Fischer et al. |
| 4,780,224 | A | 10/1988 | Jao |
| 4,787,992 | A | 11/1988 | Waynick |
| 4,810,396 | A | 3/1989 | Jao et al. |
| 4,810,398 | A | 3/1989 | Van Kruchten et al. |
| 4,824,584 | A | 4/1989 | Muir et al. |
| 4,830,767 | A | 5/1989 | Waynick |
| 4,902,435 | A | 2/1990 | Waynick |
| 4,904,399 | A | 2/1990 | Waynick |
| 4,929,371 | A | 5/1990 | Waynick |
| 5,084,193 | A | 1/1992 | Waynick |
| 5,126,062 | A | 6/1992 | Barnes |
| 5,190,678 | A | 3/1993 | Swartz et al. |
| 5,308,514 | A | 5/1994 | Olson et al. |
| 5,338,467 | A | 8/1994 | Olson et al. |
| 6,239,083 | B1 | 5/2001 | Muir |
| 6,432,889 | B1 | 8/2002 | Kinoshita et al. |
| 6,596,672 | B1 | 7/2003 | Carrick et al. |
| 6,869,111 | B2 | 3/2005 | Goto et al. |
| 6,875,731 | B1 | 4/2005 | Bence |
| 7,241,723 | B2 | 7/2007 | Zhang et al. |
| 7,294,608 | B2 | 11/2007 | Oldiges et al. |
| 7,517,837 | B2 | 4/2009 | Kurosky et al. |
| 9,458,406 | B2 * | 10/2016 | Waynick ..... C10M 169/04 |
| 2003/0111838 | A1 | 6/2003 | Goto et al. |
| 2004/0214732 | A1 | 10/2004 | Oldiges et al. |
| 2004/0235679 | A1 | 11/2004 | Kurosky et al. |
| 2005/0054541 | A1 | 3/2005 | Zhang et al. |
| 2005/0215442 | A1 | 9/2005 | Sivik et al. |
| 2006/0025317 | A1 | 2/2006 | Olson et al. |
| 2006/0223719 | A1 | 10/2006 | Riff et al. |
| 2007/0060485 | A1 * | 3/2007 | Waynick ..... C10M 141/08 508/388 |
| 2009/0305920 | A1 * | 12/2009 | Kato ..... C10M 169/06 508/162 |
| 2011/0021391 | A1 | 1/2011 | E et al. |
| 2011/0048809 | A1 | 3/2011 | Duckworth et al. |
| 2011/0092404 | A1 | 4/2011 | Zhang et al. |
| 2011/0136709 | A1 | 6/2011 | Tanaka et al. |
| 2011/0160105 | A1 | 6/2011 | Tanaka et al. |
| 2011/0190177 | A1 | 8/2011 | Zaki |
| 2011/0195880 | A1 | 8/2011 | Kawamura et al. |
| 2011/0233473 | A1 | 9/2011 | Fletcher |

FOREIGN PATENT DOCUMENTS

| | | |
|---|---|---|
| CN | 102051257 | 5/2011 |
| CN | 102634400 | 8/2012 |
| GB | 816318 | 7/1959 |
| GB | 1239860 | 7/1971 |
| JP | 2004346120 | 12/2004 |
| JP | 2007084620 | 4/2007 |
| JP | 2009286950 | 10/2009 |
| JP | 2009292918 | 12/2009 |
| JP | 2009298890 | 12/2009 |
| WO | WO2011098616 | 8/2011 |

OTHER PUBLICATIONS

Boner, C.J. Manufacture and Application of Lubricating Greases, 1954, p. 369, Hafner Publishing Company, Inc.

* cited by examiner

CALCIUM HYDROXYAPATITE BASED CALCIUM SULFONATE GREASE COMPOSITIONS AND METHOD OF MANUFACTURE

CROSS-REFERENCE TO RELATED APPLICATION

This application is a continuation of U.S. application Ser. No. 13/664,768, filed on Oct. 31, 2012, which claims the benefit of U.S. provisional patent application No. 61/553,674 filed Oct. 31, 2011.

BACKGROUND OF THE INVENTION

1. Field of the Invention

This invention relates to overbased calcium sulfonate greases made with added calcium hydroxyapatite as a base source and the method for manufacturing such greases to provide improvements in both thickener yield and expected high temperature utility as demonstrated by dropping point, even when the oil-soluble overbased calcium sulfonate used to make the grease is considered to be of poor quality.

2. Description of Related Art

Overbased calcium sulfonate greases have been an established grease category for many years. One known process for making such greases is a two-step process involving the steps of "promotion" and "conversion." Typically the first step ("promotion") is to react a stoichiometric excess amount of calcium oxide (CaO) or calcium hydroxide ($Ca(OH)_2$) as the base source with an alkyl benzene sulfonic acid, carbon dioxide ($CO_2$), and with other components to produce an oil soluble overbased calcium sulfonate with amorphous calcium carbonate dispersed therein. These overbased oil-soluble calcium sulfonates are typically clear and bright and have Newtonian rheology. In some cases, they may be slightly turbid, but such variations do not prevent their use in preparing overbased calcium sulfonate greases. For the purposes of this disclosure, the terms "overbased oil-soluble calcium sulfonate" and "oil-soluble overbased calcium sulfonate" and "overbased calcium sulfonate" refer to any overbased calcium sulfonate suitable for making calcium sulfonate greases. Typically the second step ("conversion") is to add a converting agent or agents, such as propylene glycol, iso-propyl alcohol, formic acid or acetic acid, to the product of the promotion step, along with a suitable base oil (such as mineral oil), to convert the amorphous calcium carbonate to a very finely divided dispersion of crystalline calcium carbonate. Because an excess of calcium hydroxide or calcium oxide is used to achieve overbasing, a small amount of residual calcium oxide or calcium hydroxide may also be present and will be dispersed. The crystalline form of the calcium carbonate is preferably calcite. This extremely finely divided calcium carbonate, also known as a colloidal dispersion, interacts with the calcium sulfonate to form a grease-like consistency. Such overbased calcium sulfonate greases produced through the two-step process have come to be known as "simple calcium sulfonate greases" and are disclosed, for example, in U.S. Pat. Nos. 3,242,079; 3,372,115; 3,376,222, 3,377,283; and 3,492,231.

It is also known in the prior art to combine these two steps, by carefully controlling the reaction, into a single step. In this one-step process, the simple calcium sulfonate grease is prepared by reaction of an appropriate sulfonic acid with either calcium hydroxide or calcium oxide in the presence of carbon dioxide and a system of reagents that simultaneously act as both promoter (creating the amorphous calcium carbonate overbasing by reaction of carbon dioxide with an excess amount of calcium oxide or calcium hydroxide) and converting agents (converting the amorphous calcium carbonate to very finely divided crystalline calcium carbonate). Thus, the grease-like consistency is formed in a single step wherein the overbased, oil-soluble calcium sulfonate (the product of the first step in the two-step process) is never actually formed and isolated as a separate product. This one-step process is disclosed, for example, in U.S. Pat. Nos. 3,661,622; 3,671,012; 3,746,643; and 3,816,310.

In addition to simple calcium sulfonate greases, calcium sulfonate complex grease compounds are also known in the prior art. These complex greases are typically produced by adding a strong calcium-containing base, such as calcium hydroxide or calcium oxide, to the simple calcium sulfonate grease produced by either the two-step or one-step process and reacting with stoichiometrically equivalent amounts of complexing acids, such as 12 hydroxystearic acid, boric acid, acetic acid, or phosphoric acid. The claimed advantages of the calcium sulfonate complex grease over the simple grease include reduced tackiness, improved pumpability, and improved high temperature utility. Calcium sulfonate complex greases are disclosed, for example, in U.S. Pat. Nos. 4,560,489; 5,126,062; 5,308,514; and 5,338,467.

All of the known prior art teaches the use of calcium oxide or calcium hydroxide as the sources of basic calcium for production of calcium sulfonate greases or as a required component for reacting with complexing acids to form calcium sulfonate complex greases. The known prior art generally teaches that the addition of calcium hydroxide or calcium oxide needs to be in an amount sufficient (when added to the amount of calcium hydroxide or calcium oxide present in the overbased oil-soluble calcium sulfonate) to provide a total level of calcium hydroxide or calcium oxide sufficient to fully react with the complexing acids. There are also prior art references for using tricalcium phosphate as an additive in lubricating greases. For instance, U.S. Pat. Nos. 4,787,992; 4,830,767; 4,902,435; 4,904,399; 4,929,371 all teach using tricalcium phosphate as an additive for lubricating greases. However, it is believed that no prior art references teach the use of calcium hydroxyapatite, $Ca_5(PO_4)_3OH$, as a calcium-containing base for reaction with acids to make lubricating greases, including calcium sulfonate-based greases. The known prior art also generally teaches against the use of calcium carbonate (as a separate ingredient or as an "impurity" in the calcium hydroxide or calcium oxide, other than the presence of the amorphous calcium carbonate dispersed in the calcium sulfonate after carbonation) in making calcium sulfonate greases for at least two reasons. The first being that calcium carbonate is generally considered to be a weak base, unsuitable for reacting with complexing acids. The second being that the presence of unreacted solid calcium compounds (including calcium carbonate, calcium hydroxide, calcium oxide, or calcium hydroxyapatite) interferes with the conversion process, resulting in inferior grease compounds if the unreacted solids are not removed prior to conversion or before conversion is completed.

Additionally, the prior art does not provide a calcium sulfonate complex grease with both improved thickener yield and dropping point. The known prior art requires an amount of overbased calcium sulfonate of least 36% (by weight of the final grease product) suitable grease in the NGLI No. 2 category with a demonstrated dropping point of at least 575 F. The overbased oil-soluble calcium sulfonate is one of the most expensive ingredients in making calcium sulfonate grease, therefore it is desirable to reduce the amount of this ingredient while still maintaining a desirable level of firmness in the final grease (thereby improving thickener yield). Specifically, it is desirable to have an overbased calcium sulfonate grease wherein the percentage of overbased oil-soluble calcium sulfonate is less than 36% and the dropping point is consistently 575 F or higher when the consistency is within an NLGI No. 2 grade (or the worked 60 stroke penetration of the grease is between 265 and 295). Higher dropping points are considered desirable since the dropping point is the first and most easily determined guide as to the high temperature utility limitations of a lubricating grease.

SUMMARY OF THE INVENTION

This invention relates to overbased calcium sulfonate greases made with the addition of calcium hydroxyapatite and the method for manufacturing such greases to provide improvements in both thickener yield (requiring less overbased oil-soluble calcium sulfonate while maintaining acceptable penetration measurements) and expected high temperature utility as demonstrated by dropping point. These benefits are achieved according to the invention even when using what is considered to be poor quality overbased oil-soluble calcium sulfonates.

Although the known prior art consistently and uniformly teaches the use of calcium hydroxide or calcium oxide as the base materials necessary to fully react with complexing acids, it has been found that a suitable calcium sulfonate complex grease may be produced according to the invention by adding calcium hydroxyapatite in an amount sufficient to react with and neutralize at least a portion of subsequently added complexing acids. The known prior art discloses the use of tricalcium phosphate as an additive in lubricating greases, but does not disclose the use of calcium hydroxyapatite as a calcium-containing base for reaction with acids to make calcium sulfonate-based greases.

Calcium hydroxyapatite has the formula $Ca_5(PO_4)_3OH$ and is a strong base comparable in base strength to calcium hydroxide, $Ca(OH)_2$, due to the hydroxide ion present in its crystal structure. The formula for calcium hydroxyapatite is sometimes written as the algebraically equivalent empirical formula $3Ca_3(PO_4)_2$—$Ca(OH)_2$. However, this empirical formula is extremely misleading since it incorrectly implies that calcium hydroxyapatite is simply a mixture of tricalcium phosphate, $Ca_3(PO_4)_2$, and calcium hydroxide, $Ca(OH)_2$. In fact, calcium hydroxyapatite has its own crystal structure, distinct from the crystal structure of pure calcium hydroxide, $Ca(OH)_2$, and from what would be expected of the crystal structure of pure tricalcium phosphate, $Ca_3(PO_4)_2$. Furthermore, the functional reactivity of a hydroxide equivalent amount of calcium hydroxyapatite is distinctly different from and superior to a corresponding hydroxide equivalent amount of calcium hydroxide when used to make calcium sulfonate-based greases according to the invention, as shown in subsequent examples.

The use of calcium hydroxyapatite in calcium sulfonate grease compositions according to the invention works well with overbased oil-soluble calcium sulfonates of varying quality. Certain overbased oil-soluble calcium sulfonates marketed and sold for the manufacture of calcium sulfonate-based greases provide products with unacceptably low dropping points. Such overbased oil-soluble calcium sulfonates are referred to as "poor quality" overbased oil-soluble calcium sulfonates throughout this application. Although comparative chemical analyses of good quality and poor quality overbased oil-soluble calcium sulfonates has been performed, it is believed that the precise reason for this low dropping point problem has not been determined. This problem occurs when using prior art technologies for making both simple calcium sulfonate greases, such as the two-step and one-step processes described above, and calcium sulfonate complex greases. This problem has also been noted to occur when using the calcium carbonate based grease technology disclosed in the inventor's co-pending U.S. Application that also claims priority to U.S. Provisional Application Ser. No. 61/553,674. According to the invention of the co-pending application, calcium sulfonate greases with improved thickener yield and dropping points consistently above 575 F are provided using most commercially available overbased oil-soluble calcium sulfonates; however, there are a very few overbased oil-soluble calcium sulfonates for which the calcium carbonate based grease technology does not provide acceptable dropping points. This problem has been shown to be entirely due to some chemical inadequacy of the poor quality overbased oil-soluble calcium sulfonate ingredient, since prior art technologies are also adversely affected. While most commercially available overbased calcium sulfonates are considered to be good quality, it is desirable to achieve both improved thickener yield and higher dropping points regardless of whether a good quality or a poor quality calcium sulfonate is used. It has been found according to the invention, that both improved thickener yield and higher dropping point may be achieved with either a good quality or a poor quality calcium sulfonate.

Additionally, the known prior art generally requires an amount of overbased oil-soluble calcium sulfonate of 36% or greater (by weight of the final grease product) to achieve a firm enough grease while also having dropping point of 575 F or higher. The overbased oil-soluble calcium sulfonate is one of the most expensive ingredients in making a calcium sulfonate grease, so it is desirable to reduce the amount of this ingredient. Such a reduction has been achieved with the greases according to the invention without resulting in a grease that is too soft or has an inferior dropping point.

According to one preferred embodiment of the invention, a highly overbased oil-soluble calcium sulfonate grease composition is provided having the following ingredients by weight percent of the final grease product (although, some ingredients, such as water, may not be in the final grease product or may not be in the concentrations indicated for addition): less than 36% overbased calcium sulfonate, 2-20% calcium hydroxyapatite; an optional amount of 0.07% to 0.74% of calcium hydroxide or calcium oxide; an optional 2%-20% added calcium carbonate; 1.5% to 10% water; 0.1%-5% of one or more other converting agents, such as alcohols, ethers, glycols, glycol ethers, glycol polyethers, and carboxylic acids; an optional 0.5%-5% facilitating acid; and 2.8% to 11% (total) of one or more complexing acids, such as boric acid, acetic acid, 12 hydroxystearic acid, or phosphoric acid (when a complex grease is desired). The calcium sulfonate complex grease according to this preferred embodiment is an NGLI No. 2 grade grease having a dropping point of 575 F or higher.

According to one embodiment of the invention, a calcium sulfonate complex grease is produced by combining a highly overbased oil-soluble calcium sulfonate comprising amorphous calcium carbonate as the primary overbasing material with an appropriate initial amount of a suitable base oil, such as mineral oil, which is then admixed with finely divided calcium hydroxyapatite as the sole added calcium-containing base and a converting agent or agents, then heated as needed to a temperature range of about 190 F to 200 F for a period of time necessary for effective conversion of the amorphous calcium carbonate to an extremely finely divided dispersion of crystalline calcium carbonate in the presence of the previously added calcium hydroxyapatite base. After conversion is complete, one or more complexing acids are added. A portion of one of more of these complexing acids may be added prior to conversion of the simple calcium sulfonate grease, with the remainder of the one or more complexing acids added after conversion. The mixture is then rapidly heated to 380 F to 400 F to remove water and volatile reaction byproducts, then cooled, with additional base oil added as required. The final complex grease product is then milled as appropriate according to methods known in the art to achieve a smooth, homogenous, high quality calcium sulfonate complex grease.

According to another embodiment of the invention, a calcium sulfonate complex grease is produced according to the above described steps except that the amount of the calcium-containing base calcium hydroxyapatite added before conversion is less than sufficient to react with and neutralize all the subsequently added complexing acids. In this embodiment, calcium hydroxide, calcium oxide, or calcium carbonate or combinations thereof may be used to complete those reactions. Preferably, the calcium hydroxide and/or calcium oxide constitute no more than 75% of the hydroxide equivalent basicity provided by the total of the calcium hydroxyapatite, calcium hydroxide, and calcium oxide. When calcium carbonate is used, it may be either from the overbased oil-soluble calcium sulfonate or may be added as a separate ingredient before the complexing acids are added. Although the prior art generally teaches against the addition of calcium carbonate as being too weak of base to react with strong complexing acids in a way to provide good grease properties, it has been found to work well according to the invention.

According to yet another embodiment of the invention, the calcium hydroxyapatite may be added after conversion in cases where all or part of the complexing acids are also added after conversion.

DESCRIPTION OF THE PREFERRED EMBODIMENTS

According to one embodiment of the invention, an overbased calcium sulfonate grease is produced by reacting and mixing certain compounds comprising: (a) a highly overbased oil-soluble calcium sulfonate comprising amorphous calcium carbonate as the primary overbasing material; (b) a suitable base oil of an amount appropriate to provide a final acceptable product consistency; (c) finely divided calcium hydroxyapatite as an oil-insoluble solid calcium-containing base added before and/or after conversion in an amount sufficient to fully react with and neutralize one or more complexing acids; (d) a converting agent or agents, some or all of which may not be in the final finished product due to volatilization during manufacture; and (e) one or more complexing acids (when a complex grease is desired), either before or after conversion or a portion added prior to conversion with another portion added after conversion. Optionally, a facilitating acid may be added prior to conversion according to another embodiment of the invention. Such facilitating acid aids in grease structure formation.

According to another embodiment of the invention, calcium hydroxyapatite may be added to the above ingredients in an amount that is insufficient to fully react with the complexing acids. In this embodiment, finely divided calcium carbonate as an oil-insoluble solid calcium-containing base may be added, preferably before conversion, in an amount sufficient to fully react with and neutralize the portion of any subsequently added complexing acids not neutralized by the calcium hydroxyapatite.

According to another embodiment, calcium hydroxyapatite may be added to the above ingredients in an amount that is insufficient to fully react with the complexing acids. In this embodiment, finely divided calcium hydroxide and/or calcium oxide as an oil-insoluble solid calcium-containing base may be added, preferably before conversion, in an amount sufficient to fully react with and neutralize the portion of any subsequently added complexing acids not neutralized by the co-added calcium hydroxyapatite. In this embodiment, the calcium hydroxide and/or calcium oxide preferably represents no more than 75% of the hydroxide equivalent basicity provided by the total of the added calcium hydroxyapatite, calcium hydroxide, and calcium oxide. In another embodiment, calcium carbonate may also be added with the calcium hydroxyapatite, calcium hydroxide and/or calcium oxide, with the calcium carbonate being added either before or after reacting with complexing acids. When the amounts of calcium hydroxyapatite, calcium hydroxide, and/or calcium oxide are not sufficient to neutralize the complexing acid or acids added, calcium carbonate is preferably added in an amount that is more than sufficient to neutralize any remaining complexing acid or acids.

The highly overbased oil-soluble calcium sulfonate used according to this embodiment of the invention can be any typical to that documented in the prior art, such as U.S. Pat. Nos. 4,560,489; 5,126,062; 5,308,514; and 5,338,467. The highly overbased oil-soluble calcium sulfonate may be produced in situ according to such known methods or may be purchased as a commercially available product. Such highly overbased oil-soluble calcium sulfonates will have a Total Base Number (TBN) value not lower than 200, preferably not lower than 300, and most preferably about 400. Commercially available overbased calcium sulfonates of this type include, but are not limited to, the following: Hybase C401 as supplied by Chemtura USA Corporation; Syncal OB 400 and Syncal OB405-WO as supplied by Kimes Technologies International Corporation; Lubrizol 75GR, Lubrizol 75NS, Lubrizol 75P, and Lubrizol 75WO as supplied by Lubrizol Corporation. The amount of the highly overbased oil-soluble calcium sulfonate in the final grease according to this embodiment of the invention can vary, but will generally be between 10 and 45%. Preferably, the amount of the highly overbased oil-soluble calcium sulfonate according to an embodiment of the invention is between 20 and 36% and most preferably between 25 and 32% based on the total weight of the grease.

The calcium hydroxyapatite added pre-conversion or post-conversion shall be finely divided with a mean particle size of less than 20 microns, preferably less than 10 microns, most preferably less than or equal to 5 microns. Furthermore, the calcium hydroxyapatite will be of sufficient purity so as to have abrasive contaminants such as silica and alumina at a level low enough to not significantly impact the anti-wear properties of the resulting grease. Ideally, for best results, the calcium hydroxyapatite should be either food grade or U.S. Pharmacopeia grade. The amount of calcium hydroxyapatite added will be between 2.0% and 20%, preferably 4% and 15%, most preferably 5% and 10%, based on the total weight of the grease, although more can be added, if desired, after conversion and all reaction with complexing acids is complete.

Any petroleum-based naphthenic or paraffinic mineral oils commonly used and well known in the grease making art may be used as the base oil according to the invention. Synthetic base oils may also be used in the greases of the present invention. Such synthetic base oils include polyalphaolefins (PAO), diesters, polyol esters, polyethers, alkylated benzenes, alkylated naphthalenes, and silicone fluids. In some cases, synthetic base oils may have an adverse effect if present during the conversion process as will be understood by those of ordinary skill in the art. In such cases, those synthetic base oils should not be initially added, but added to the grease making process at a stage when the adverse effects will be eliminated or minimized, such as after conversion. Naphthenic and paraffinic mineral base oils are preferred due to their lower cost and availability. The total amount of base oil added (including that initially added and any that may be added later in the grease process to achieve the desired consistency) will typically be between 30% and 60%, preferably 35% and 55%, most preferably 40% and 50%, based on the final weight of the grease.

The calcium carbonate used according to one embodiment of the invention shall be finely divided with a mean particle size of less than 20 microns, preferably less than 10 microns, most preferably less than or equal to 5 microns. Furthermore, the calcium carbonate preferably is of sufficient purity so as to have abrasive contaminants such as silica and alumina at a level low enough to not significantly impact the anti-wear properties of the resulting grease. Ideally, for best results, the calcium carbonate should be either food grade or U.S. Pharmacopeia grade. The amount of calcium carbonate added will be between 2.0% and 20%, preferably 4% and 15%, most preferably 6% and 10%, based on the final weight of the grease.

The calcium hydroxide and calcium oxide added pre-conversion according to another embodiment shall be finely divided with a mean particle size of less than 20 microns, preferably less than 10 microns, most preferably less than or equal to 5 microns. Furthermore, the calcium hydroxide and calcium oxide will be of sufficient purity so as to have abrasive contaminants such as silica and alumina at a level low enough to not significantly impact the anti-wear properties of the resulting grease. Ideally, for best results, the calcium hydroxide and calcium oxide should be either food grade or U.S. Pharmacopeia grade. The total amount of calcium hydroxide and/or calcium oxide will be between 0.07% and 0.74%, preferably 0.15% and 0.63%, most preferably 0.18% and 0.37%, based on the total weight of the grease.

One or more converting agents, such as alcohols, ethers, glycols, glycol ethers, glycol polyethers, carboxylic acids, inorganic acids, organic nitrates, and any other compounds that contain either active or tautomeric hydrogen, are used according to this embodiment. The amount of such converting agents added, based on the final weight of the grease, will be between 0.1% and 5%, preferably 1.0% and 4%, most preferably 1.5% and 3.0%. Depending on the converting agents used, they may be removed by volatilization during the manufacturing process. Especially preferred are the lower molecular weight glycols such as hexylene glycol and propylene glycol. Water is typically also added in an amount between 1.5% and 10%, preferably between 2.0% and 5.0%, most preferably between 2.2% and 4.5%, based on the weight of the final grease. It should be noted that some converting agents may also serve as complexing acids, to produce a calcium sulfonate complex grease according to another embodiment of the invention described below. Such materials will simultaneously provide both functions of converting and complexing.

Although not required, a small amount of a facilitating acid may be added to the mixture prior to conversion according to another embodiment of the invention. Suitable facilitating acids, such as an alkyl benzene sulfonic acid, having an alkyl chain length typically will be between 8 to 16 carbons, may help to facilitate efficient grease structure formation. Most preferably, this alkyl benzene sulfonic acid comprises a mixture of alkyl chain lengths that are mostly about 12 carbons in length. Such benzene sulfonic acids are typically referred to as dodecylbenzene sulfonic acid ("DDBSA"). Commercially available benzene sulfonic acids of this type include JemPak 1298 Sulfonic Acid as supplied by JemPak GK Inc., Calsoft LAS-99 as supplied by Pilot Chemical Company, and Biosoft S-101 as supplied by Stepan Chemical Company. When the alkyl benzene sulfonic acid is used in the present invention, it is added before conversion in an amount of 0.50% to 5.0%, preferably 1.0% to 4.0%, most preferably 2.0% to 3.6%, based on the final weight of the grease. If the calcium sulfonate is made in situ using alkyl benzene sulfonic acid, the facilitating acid added according to this embodiment is in addition to that required to produce the calcium sulfonate.

One or more complexing acids are also used according to this embodiment when a complex grease is desired. A portion of one or more of these complexing acids may optionally be added before conversion with the remainder added after conversion. Complexing acids used in this embodiment will comprise at least one and preferably two or more of the following: long chain carboxylic acids, short chain carboxylic acids, boric acid, and phosphoric acid. The long chain carboxylic acids suitable for use in accordance with the invention comprise aliphatic carboxylic acids with at least 12 carbon atoms. Preferably, the long chain carboxylic acids comprise aliphatic carboxylic acids with at least 16 carbon atoms. Most preferably, the long chain carboxylic acid is 12-hydroxystearic acid. The long chain carboxylic acid will be present between 0.5% and 5.0%, preferably 1.0% to 4.0%, most preferably 2.0% to 3.0%, based on the final weight of the grease.

Short chain carboxylic acids suitable for use in accordance with the invention comprise aliphatic carboxylic acids with no more than 8 carbon atoms, and preferably no more than 4 atoms. Most preferably, the short chain carboxylic acid is acetic acid. Short chain carboxylic acids will be present between 0.05% and 2.0%, preferably 0.1% to 1.0%, most preferably 0.2% to 0.5%, based on the final weight of the grease. Any compound that can be expected to react with water or other components used in producing a grease in accordance with this invention with such reaction generating a long chain or short chain carboxylic acid are also suitable for use. For instance, using acetic anhydride would, by reaction with water present in the mixture, form the acetic acid to be used as a complexing acid. Likewise, using methyl 12-hydroxystearate would, by reaction with water present in the mixture, form the 12-hydroxystearic acid to be used as a complexing acid. Alternatively, additional water may be added to the mixture for reaction with such components to form the necessary complexing acid if sufficient water is not already present in the mixture.

If boric acid is used as a complexing acid according to this embodiment, an amount between 0.4% to about 4.0%, preferably 0.7% to 3.0%, and most preferably 1.0% and 2.5%, based on the total weight of the grease, is added. The boric acid may be added after first being dissolved or slurried in water, or it can be added without water. Preferably, the boric acid will be added during the manufacturing process such that water is still present. Alternatively, any of the well-known inorganic boric acid salts may be used instead of boric acid. Likewise, any of the established borated organic compounds such as borated amines, borated amides, borated esters, borated alcohols, borated glycols, borated ethers, borated epoxides, borated ureas, borated carboxylic acids, borated sulfonic acids, borated epoxides, borated peroxides and the like may be used instead of boric acid. If phosphoric acid is used as a complexing acid, an amount between 0.4% to 4.0%, preferably 1.0% and 3.0%, most preferably 1.4% and 2.0%, based on the final weight of the grease, is added. The percentages of various complexing acids described herein refer to pure, active compounds. If any of these complexing acids are available in a diluted form, they may still be suitable for use in the present invention. However, the percentages of such diluted complexing acids will need to be adjusted so as to take into account the dilution factor and bring the actual active material into the specified percentage ranges.

Other additives commonly recognized within the grease making art may also be added to either the simple grease embodiment or the complex grease embodiment of the invention. Such additives can include rust and corrosion inhibitors, metal deactivators, metal passivators, antioxidants, extreme pressure additives, antiwear additives, chelating agents, polymers, tackifiers, dyes, chemical markers, fragrance imparters, and evaporative solvents. The latter category can be particularly useful when making open gear lubricants and braided wire rope lubricants. The inclusion of any such additives is to be understood as still within the scope of the present invention.

The compositions according to the invention are preferably made according to the methods described herein. One preferred method comprises the steps of: (1) admixing in a suitable grease manufacturing vessel a highly overbased oil-soluble calcium sulfonate and an appropriate amount of a suitable base oil at a temperature of between ambient air temperature and about 190 F; (2) admixing finely divided calcium hydroxyapatite in an amount sufficient to fully react with and neutralize subsequently added complexing acids; (3) admixing a converting agent or agents; (4) admixing from 0% to 100% of one or more of suitable complexing acids based on the total weight to be added of those complexing acids; (5) continuing to mix while heating as required to about 190 F-200 F and remaining at that temperature range until conversion of the amorphous calcium carbonate to very finely divided crystalline calcium carbonate is complete; (6) adding any complexing acids required that were not previously added before conversion; (7) mixing and heating to a temperature sufficiently high to insure removal of water and any volatile reaction byproducts and optimize final product quality; (8) cooling the grease while adding additional base oil as needed; (9) adding remaining desired additives as are well known in the art; and, if desired, (10) milling the final grease as required to obtain a final smooth homogenous product.

According to several other embodiments, the method is the same as above except that step (2) involves one of the following: (a) admixing finely divided calcium hydroxyapatite and calcium carbonate in an amount sufficient to fully react with and neutralize subsequently added complexing acids, according to one embodiment; (b) admixing finely divided calcium hydroxyapatite and calcium hydroxide and/or calcium oxide in an amount sufficient to fully react with and neutralize subsequently added complexing acids, with the calcium hydroxide and/or calcium oxide preferably being present in an amount not more than 75% of the hydroxide equivalent basicity provided by the total of the added calcium hydroxide and/or calcium oxide and the calcium hydroxyapatite, according to another embodiment of the invention; or (c) admixing finely divided calcium hydroxyapatite and calcium hydroxide and/or calcium oxide in an amount insufficient to fully react with and neutralize subsequently added complexing acids, with the calcium hydroxide and/or calcium oxide preferably being present in an amount not more than 75% of the hydroxide equivalent basicity provided by the total of the added calcium hydroxide and/or calcium oxide and the calcium hydroxyapatite, according to another embodiment of the invention.

According to yet another embodiment, the process for making the compositions according to the invention comprises any of the previously described processes wherein a portion of the calcium hydroxyapatite, calcium carbonate, and/or one or more complexing acids are added prior to conversion, with another portion of the calcium hydroxyapatite, calcium carbonate, and/or one or more complexing acids being added after conversion. Alternatively, all of the calcium carbonate may be added after conversion. When added post-conversion, the calcium hydroxyapatite is preferably sufficient to completely react with and neutralize any complexing acids added post-conversion.

Any of the methods according to the invention may occur in either an open or closed kettle as is commonly used for grease manufacturing. The conversion process can be achieved at normal atmospheric pressure or under pressure in a closed kettle. Manufacturing in open kettles is preferred since such grease manufacturing equipment is commonly available.

Certain aspects of the process are not critical to obtaining calcium sulfonate grease compositions according to the invention. For instance, before conversion occurs, the order that the calcium hydroxyapatite, calcium carbonate, calcium hydroxide and/or calcium oxide, water, and other converting agents are added relative to each other is not important. Also, the temperature at which these ingredients are added is not critical, but it is preferred that they be added before the temperature reaches 190 F to 200 F. However, for the sake of convenience, these components are usually added at the beginning of the process, as will be illustrated in the examples provided below. When more than one complexing acid is used, the order in which they are added either before or after conversion is not generally important.

According to one preferred method of making a calcium sulfonate grease according to the invention, water is removed from the grease after conversion. Preferably, the grease is heated after conversion is complete and all complexing acids (if a complex grease is being made) have been added to remove the water as quickly as possible. This is generally possible by heating and mixing the batch under open conditions. Having water in the grease batch for prolonged periods of time may result in degradation of thickener yield, dropping point, or both, and such adverse effects may be avoided by removing the water quickly.

The converted grease should be heated to a temperature sufficiently high to remove the water that was initially added as a converting agent, as well as any water formed by chemical reactions during the formation of the grease. Generally, this temperature will be between 250 F and 300 F, preferably 300 F to 380 F, most preferably 380 F to 400 F. If polymeric additives are added to the grease, they should preferably not be added until the grease temperature reaches 300 F. Polymeric additives can, if added in sufficient concentration, hinder the effective volatilization of water. Therefore, polymeric additives should preferably be added to the grease only after all water has been removed.

As previously noted, commercially available overbased oil-soluble calcium sulfonates vary in quality based on the dropping point of the grease made with such overbased oil-soluble calcium sulfonates according to various methods. The overbased oil-soluble calcium sulfonates producing greases having higher dropping points (above 575 F) are considered to be "good" quality calcium sulfonates for purposes of this invention and those producing greases having lower dropping points are considered to be "poor" quality for purposes of this invention. Several batches of greases were made using commercially available overbased oil-soluble calcium sulfonates to demonstrate the differences in dropping points for greases where the only variable was the particular overbased oil-soluble calcium sulfonate used. These batches of grease (Examples 1-9, as described below) use calcium carbonate as the sole calcium base source, the general composition and methodology for which is disclosed as an embodiment in the inventor's co-pending application Ser. No. 13/664,574, also claiming priority to U.S. Provisional Application Ser. No. 61/553,674.

The quantities for all ingredients used in Examples 1-8 were identical according to the amounts indicated below. For purposes of comparison with later examples, the quantities in Example 9 were approximately half of the quantities in the other examples and are indicated in parentheses below. These calcium sulfonate complex grease batches were all made according to the following process: 720.0 grams (360.0 grams in Example 9) of a 400 TBN overbased oil-soluble calcium sulfonate was added to an open mixing vessel followed by 667.5 grams (339.8 grams in Example 9) of a solvent neutral group 1 paraffinic base oil having a viscosity of about 600 SUS at 100 F, and 20.0 grams of PAO having a viscosity of 4 cSt at 100 C. Mixing without heat began using a planetary mixing paddle. Then 72.00 grams (28.4 grams in Example 9) of a primarily C12 alkylbenzene sulfonic acid was added. After 20 minutes, 151.6 grams (75.80 grams in Example 9) of finely divided calcium carbonate with a mean particle size below 5 microns was added and allowed to mix in for 20 minutes. Then 36.00 grams (18.0 grams) of hexylene glycol and 90.0 grams (45.0 grams in Example 9) water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Immediately, 56.80 grams (28.40 grams in Example 9) of 12-hydroxystearic acid was added along with 5.60 grams (2.8 grams in Example 9) glacial acetic acid. Then 38.00 grams (19.0 grams in Example 9) of a 75% solution of phosphoric acid in water was added. These three acids were the complexing acids for this batch. The mixture was then heated with an electric heating mantle while continuing to stir. When the grease reached 300 F, 55.60 grams (27.80 grams) of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, additional paraffinic base oil was slowly added to bring the final grease to an NLGI No. 2 grade consistency. When the temperature of the grease cooled to 200 F, 10.00 grams (5.0 grams in Example 9) of a polyisobutylene polymer was added. Mixing continued until the grease reached a temperature of 170 F. The grease was then removed from the mixer and given three passes through a three-roll mill to achieve the final smooth homogenous texture. The grease batches made, using particular overbased oil-soluble calcium sultanates noted by sample number, had the characteristics listed below in Table 1:

TABLE 1

| Example No. | Overbased Calcium Sulfonate Sample No. | Dropping Point (F.) | 60 Stroke Worked Penetration | Quality of Overbased Calcium Sulfonate |
|---|---|---|---|---|
| 1 | 1 | 636 | 283 | Good |
| 2 | 2 | Greater than 640 | 295 | Good |
| 3 | 3 | 643 | 288 | Good |
| 4 | 4 | Greater than 640 | 272 | Good |
| 5 | 5 | 640 | 281 | Good |
| 6 | 6A | 496 | 280 | Poor |
| 7 | 6A | 483 | 278 | Poor |
| 8 | 6B | 490 | 289 | Poor |
| 9 | 6C | 509 | 273 | Poor |

For purposes of this invention, references to "good" quality calcium sulfonates include any that would result in a grease having a dropping point above 575 F using the above described calcium carbonate composition and methodology (and as disclosed in co-pending application Ser. No. 13/664,574) and/or any prior art composition and methodology. Similarly, for purposes of this invention, references to "poor" quality calcium sulfonates include any that would result in a grease having a dropping point less than or equal to 575 F using the above described calcium carbonate composition and methodology (and as disclosed in co-pending application Ser. No. 13/664,574) and/or any prior art composition and methodology.

Examples 1-5 all used different overbased oil-soluble calcium sulfonate samples (i.e. different commercially available products) and all resulted in calcium sulfonate complex greases with dropping points above 600 F. The overbased oil-soluble calcium sulfonate samples used in Examples 6-9 were all from the same commercial source and were the same commercial product; however, to ensure that the issues experienced with these examples was not isolated to a particular batch of overbased oil-soluble calcium sulfonate, the samples used in Examples 8 and 9 were from two other different batches (denoted as 6B and 6C, respectively) than that used in Examples 6 and 7 (denoted as 6A). Examples 6-9 all resulted in dropping points under 510 F, well under the desired dropping point of 575 F or higher. As the only variable in the making of these example batches of grease (other than equivalent reduction of ingredients in Example 9) was the overbased oil-soluble calcium sulfonate used, the difference in dropping point must be attributed to some anomaly in the particular calcium sulfonate used.

The same overbased oil-soluble calcium sulfonates, of both good and poor quality, used in the above examples were also used to make overbased calcium sulfonate grease compositions according to the invention. These grease compositions and methods for making such compositions according to the present invention are further described and explained in relation to the following examples:

Example 10

A calcium sulfonate complex grease was prepared as follows: 720.0 grams of the same poor quality 400 TBN overbased oil-soluble calcium sulfonate used in Example 8 (overbased oil-soluble calcium sulfonate Sample No. 6B) was added to an open mixing vessel followed by 697.9 grams of a solvent neutral group 1 paraffinic base oil having a viscosity of about 600 SUS at 100 F, and 20.0 grams of PAO having a viscosity of 4 cSt at 100 C. Mixing without heat began using a planetary mixing paddle. Then 72.00 grams of a primarily C12 alkylbenzene sulfonic acid was added. After 20 minutes, 151.6 grams of finely divided calcium hydroxyapatite with a mean particle size below 5 microns was added and allowed to mix in for 20 minutes. This amount of calcium hydroxyapatite was sufficient to provide more than the required amount of hydroxide basicity to react with and neutralize the 12-hydroxystearic acid and acetic acid (the complexing acids) that would be added after conversion. Then 36.00 grams of hexylene glycol and 90.0 grams water were added as converting agents. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Immediately, 56.80 grams of 12-hydroxystearic acid was added along with 5.60 grams glacial acetic acid. These two acids were the complexing acids for this batch, and they fully reacted with and were neutralized by the hydroxide basicity provided by the calcium hydroxyapatite that was added before conversion. The mixture was then heated with an electric heating mantle while continuing to stir. When the grease reached 300 F, 55.60 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, a 174.5 gram portion of the same paraffinic base oil was slowly added. When the temperature of the grease cooled to 200 F, 10.00 grams of a polyisobutylene polymer was added. Mixing continued until the grease reached a temperature of 170 F. A portion of the grease was then removed from the mixer and given three passes through a three-roll mill to achieve a final smooth homogenous texture. The grease had an unworked penetration of 248. The grease was returned to the mixer and an additional 177.4 grams of the same paraffinic base oil was slowly added. The grease was allowed to mix for 30 minutes. It was then removed and given three passes through a three-roll mill to achieve a smooth homogenous texture. The grease had a worked penetration of 276. The percent overbased oil-soluble calcium sulfonate in the final grease was 33.1%. The dropping point was greater than 643 F.

This Example 10 grease had a dropping point well above the desired target of 575 F. In fact, the dropping point was comparable to the greases of Examples 1-5 that used good quality overbased oil-soluble calcium sulfonate. Using the grease composition and method according to this embodiment of the invention, the dropping point of this grease was around 150 F higher than the dropping point of the grease made using calcium carbonate and the exact same overbased oil-soluble calcium sulfonate in Example 8. The thickener yield also met the desired target since the percentage of the overbased oil-soluble calcium sulfonate was less than 36% (33.1% in Example 10, which is only slightly higher than the 31.4% in Example 8).

Example 11

This example was prepared to demonstrate that calcium hydroxyapatite is not simple a mixture of tricalcium phosphate and calcium hydroxide and that, in fact, it provides superior calcium sulfonate-based greases compared to a hydroxide equivalent amount of calcium hydroxide. According to this embodiment, a calcium sulfonate complex grease was prepared as follows: 720.0 grams of the same poor quality 400 TBN overbased oil-soluble calcium sulfonate used in Examples 8 and 10 (overbased oil-soluble calcium sulfonate Sample No. 6B) was added to an open mixing vessel followed by 697.9 grams of a solvent neutral group 1 paraffinic base oil having a viscosity of about 600 SUS at 100 F, and 20.0 grams of PAO having a viscosity of 4 cSt at 100 C. Mixing without heat began using a planetary mixing paddle. Then 72.00 grams of a primarily C12 alkylbenzene sulfonic acid was added. After 20 minutes, 11.2 grams of finely divided food grade purity calcium hydroxide with a mean particle size below 5 microns was added and allowed to mix in for 20 minutes. This amount of calcium hydroxide was used because, if one considered calcium hydroxyapatite to be simply a mixture of tricalcium phosphate, $Ca_3(PO4)_2$, and calcium hydroxide, $Ca(OH)_2$, then 11.2 grams would be the amount of calcium hydroxide that would be present in 151.6 grams of calcium hydroxyapatite (the amount of calcium hydroxyapatite used pre-conversion in the previous Example 10). Then 36.00 grams of hexylene glycol and 90.0 grams water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Immediately, 100.6 grams of the same calcium hydroxide was added and allowed to mix in. This additional calcium hydroxide was required to react with a corresponding amount of phosphoric acid (to be subsequently added) so as to generate the amount of tricalcium phosphate, $Ca_3(PO4)_2$, that would be present in 151.6 grams of calcium hydroxyapatite, if calcium hydroxyapatite was considered to simply be a mixture of tricalcium phosphate and calcium hydroxide.

Then, 56.80 grams of 12-hydroxystearic acid was added along with 5.60 grams glacial acetic acid. These two acids were the complexing acids for this batch. Then 118.40 grams of 75% phosphoric acid in water was added and allowed to react with the additionally added calcium hydroxide. This is the amount of phosphoric acid required to react with the additionally added calcium hydroxide to form the amount of tricalcium phosphate, $Ca_3(PO4)$, that would be present in 151.6 grams of calcium hydroxyapatite. By constructing this batch in this way, the final reacted composition of this batch and the previous Example 10 at this point in the process are identical. The only difference is that in Example 10 the hydroxide for reaction with complexing acids is provided pre-conversion by the calcium hydroxyapatite whereas in this Example 11 the same amount of hydroxide is provided pre-conversion by actual calcium hydroxide. The weights of complexing acids are the same in both batches. The weights of the poor quality overbased oil-soluble calcium sulfonate are the same in both batches. The weights of all the other components are also the same in both batches.

The mixture was then heated with an electric heating mantle while continuing to stir. When the grease reached 300 F, 55.60 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, a 174.5 gram portion of the same paraffinic base oil was slowly added. When the temperature of the grease cooled to 200 F, 10.00 grams of a polyisobutylene polymer was added. Mixing continued until the grease reached a temperature of 170 F. A portion of the grease was then removed from the mixer and given three passes through a three-roll mill to achieve a final smooth homogenous texture. The grease had an unworked penetration of 236. The grease was returned to the mixer and an additional 288.0 grams of the same paraffinic base oil was slowly added. This additional base oil was added so as to obtain a final grease with a worked penetration about the same as the grease of Example 10. In order to provide the most accurate comparison of the dropping points of the Example 10 grease and the grease of this example, it is important to have their final consistency (worked 60 stroke penetration) as nearly equal as possible. The grease was allowed to mix for 30 minutes. It was then removed and given three passes through a three-roll mill to achieve a smooth homogenous texture. The grease had a worked penetration of 271. The percent overbased oil-soluble calcium sulfonate in the final grease was 30.4%. The dropping point was 530 F.

The greases of Examples 10 and 11 both had improved thickener yield (demonstrated by overbased oil-soluble calcium sulfonate usage well below 36% in both), and their worked 60 stroke penetrations were virtually identical. However, the dropping point of the Example 11 grease was more than 110 F less than the grease of Example 10. Comparison of Examples 10 and 11 demonstrates that calcium hydroxyapatite is not simply a mixture of tricalcium phosphate and calcium hydroxide. Furthermore, it proves that with regard to reactivity to form calcium sulfonate complex thickener components with excellent dropping point properties, calcium hydroxyapatite is not equivalent to calcium hydroxide but is actually superior to calcium hydroxide as the base source. Finally, the results of Example 11 show that when making calcium sulfonate complex greases using calcium hydroxide as the calcium-containing base for reaction with complexing acids in accordance with prior art methods, satisfactory dropping point values are not obtained when a poor quality overbased oil-soluble calcium sulfonate is used. However, according to an embodiment of the composition and the method of the invention (as illustrated in Example 10), the use of calcium hydroxyapatite as the calcium base source, does provide acceptable dropping point values even when using a poor quality overbased oil-soluble calcium sulfonate. These results are not found in or expected by the known prior art.

Example 12

Another batch was made similar to the grease of Example 10 except that the good quality overbased oil-soluble calcium sulfonate of Example 4 was used (overbased oil-soluble calcium sulfonate Sample No. 4). The final grease had a worked penetration of 286. The percentage of the overbased oil-soluble calcium sulfonate was 28.9%. The dropping point was greater than 643 F.

Example 13

Another batch was made similar to the grease of Example 10 except that the good quality overbased oil-soluble calcium sulfonate of Example 3 was used. The final grease had a worked penetration of 265. The percentage of the overbased oil-soluble calcium sulfonate was 33.1%. The dropping point was greater than 650 F. This example and the previous example show that the subject invention as demonstrated in Example 10 also provides excellent results when using a good quality overbased oil-soluble calcium sulfonate.

Example 14

Another batch was made that was similar to the grease of Example 10 using the same poor quality overbased oil-soluble calcium sulfonate. The only difference was that in this batch, the calcium hydroxyapatite was added after conversion but before the complexing acids 12-hydroxystearic acid and acetic acid. The final grease had a worked penetration of 267. The percentage of the overbased oil-soluble calcium sulfonate was 33.1%. The dropping point was greater than 646 F. This example proves that when using a poor quality overbased oil-soluble calcium sulfonate, calcium hydroxyapatite can be added as a calcium containing base for reaction with complexing acids either before or after conversion, and that calcium sulfonate complex greases with excellent dropping point and improved thickener yield are obtained.

Example 15

A batch of calcium sulfonate complex grease similar to Example 10 was made using the same poor quality overbased oil-soluble calcium sulfonate. However, in this batch all of the complexing acids, 12-hydroxystearic acid and acetic acid, were added before conversion instead of after conversion. This batch was made as follows: 720.0 grams of the same poor quality 400 TBN overbased oil-soluble calcium sulfonate used in Example 10 was added to an open mixing vessel followed by 697.9 grams of a solvent neutral group 1 paraffinic base oil having a viscosity of about 600 SUS at 100 F, and 20.0 grams of PAO having a viscosity of 4 cSt at 100 C. Mixing without heat began using a planetary mixing paddle. Then 72.00 grams of a primarily C12 alkylbenzene sulfonic acid was added. After 20 minutes, 151.6 grams of finely divided calcium hydroxyapatite with a mean particle size below 5 microns was added and allowed to mix in for 20 minutes. This amount of calcium hydroxyapatite was sufficient to provide more than the required amount of hydroxide basicity to react with and neutralize the complexing acids that would be subsequently added. Then 56.80 grams of 12-hydroxystearic acid was added and allowed to mix in for 10 minutes. Then 36.00 grams of hexylene glycol was added. The mixture was heated until the temperature reached 150 F. Then 90 grams of water and 5.60 grams of glacial acetic acid were added. Heating continued until 190 F was reached. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. The mixture was then heated with an electric heating mantle while continuing to stir. When the grease reached 300 F, 55.60 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, a 174.5 gram portion of the same paraffinic base oil was slowly added. When the temperature of the grease cooled to 200 F, 10.00 grams of a polyisobutylene polymer was added. Mixing continued until the grease reached a temperature of 170 F. A portion of the grease was then removed from the mixer and given three passes through a three-roll mill to achieve a final smooth homogenous texture. The grease had an unworked penetration of 220. The grease was returned to the mixer and an additional 409.1 grams of the same paraffinic base oil was slowly added. The grease was allowed to mix for 40 minutes. It was then removed and given three passes through a three-roll mill to achieve a smooth homogenous texture. The grease had a worked penetration of 273. The percent overbased oil-soluble calcium sulfonate in the final grease was 29.9%. The dropping point was 583 F. As can be seen, this grease had a dropping point above the desired target of 575 F. The thickener yield also met the desired target since the percentage of the overbased oil-soluble calcium sulfonate was less than 36%.

Example 16

A calcium sulfonate complex grease was made similar to the grease of Example 15 except that the good quality overbased oil-soluble calcium sulfonate of Example 4 was used. The final grease has a worked 60 strokes penetration of 288. The percent overbased oil-soluble calcium sulfonate in the final grease was 31.4%. The dropping point was greater than 644 F. This example shows that the subject invention as demonstrated in Example 15 also provides excellent results when using a good quality overbased oil-soluble calcium sulfonate.

Example 17

Another batch of calcium sulfonate complex grease was made using the same poor quality overbased oil-soluble calcium sulfonate used in Example 10. However, in this batch both calcium hydroxyapatite and calcium carbonate were added before conversion. Also, 40% of the total amount of 12-hydroxystearic acid and all of the acetic acid were added before conversion. The 12-hydroxystearic acid and acetic acid were the complexing acids for this batch. The grease was made as follows: 720.0 grams of the same poor quality 400 TBN overbased oil-soluble calcium sulfonate used in Example 10 was added to an open mixing vessel followed by 585.9 grams of a solvent neutral group 1 paraffinic base oil having a viscosity of about 600 SUS at 100 F, and 20.0 grams of PAO having a viscosity of 4 cSt at 100 C. Mixing without heat began using a planetary mixing paddle. Then 72.00 grams of a primarily C12 alkylbenzene sulfonic acid was added. After 20 minutes, 151.6 grams of finely divided calcium hydroxyapatite with a mean particle size below 5 microns was added and allowed to mix in for 10 minutes. This amount of calcium hydroxyapatite was sufficient to provide more than the required amount of hydroxide basicity to react with and neutralize the complexing acids that would be subsequently added. Then 140.0 grams of finely divided calcium carbonate with a mean particle size below 5 microns was added and allowed to mix in for 10 minutes. Then 22.72 grams of 12-hydroxystearic acid was added and allowed to mix in for 10 minutes. Then 36.00 grams of hexylene glycol was added. The mixture was heated until the temperature reached 150 F. Then 90 grams of water and 5.60 grams of glacial acetic acid were added. Heating continued until 190 F was reached. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Because the grease was very heavy, an additional 146.5 gram portion of the same paraffinic base oil was slowly added. The mixture was then heated with an electric heating mantle while continuing to stir. When the grease reached 300 F, 55.60 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, a 73.24 gram portion of the same paraffinic base oil was slowly added. When the temperature of the grease cooled to 200 F, 10.00 grams of a polyisobutylene polymer was added. Mixing continued until the grease reached a temperature of 170 F. A portion of the grease was then removed from the mixer and given three passes through a three-roll mill to achieve a final smooth homogenous texture. The grease had an unworked penetration of 227. The grease was returned to the mixer and an additional 380.0 grams of the same paraffinic base oil was slowly added. The grease was allowed to mix for 40 minutes. It was then removed and given three passes through a three-roll mill to achieve a smooth homogenous texture. The grease had an unworked penetration of 265. Its worked 60 stroke penetration was between 265 and 295. The percent overbased oil-soluble calcium sulfonate in the final grease was 29.4%. The dropping point was 583 F.

Example 18

A calcium sulfonate complex grease was made similar to the grease of Example 17 except that the good quality overbased oil-soluble calcium sulfonate of Example 4 was used. The final grease has a worked 60 strokes penetration of 296. The percent overbased oil-soluble calcium sulfonate in the final grease was 30.1%. The dropping point was greater than 645 F.

In the previous examples where calcium hydroxyapatite was used as a calcium-containing base, there was sufficient hydroxide basicity provided by the calcium hydroxyapatite to react with and neutralize all the complexing acids. Even in Example 17 where both calcium hydroxyapatite and calcium carbonate were both added, the amount of calcium hydroxyapatite was sufficient to react with and neutralize all the complexing acids. The following examples are provided to demonstrate how calcium hydroxyapatite can be used in an amount insufficient to neutralize all the complexing acids provided that calcium carbonate is present in an amount sufficient to react with and neutralize the complexing acids that were not neutralized by the calcium hydroxyapatite.

Example 19

A calcium sulfonate complex grease according to an embodiment of the present invention was made using the same poor quality overbased calcium sulfonate of Example 9 and wherein calcium hydroxyapatite and calcium carbonate were added before conversion. The grease was made as follows: 360.0 grams of the poor quality 400 TBN overbased oil-soluble calcium sulfonate was added to an open mixing vessel followed by 272.6 grams of a solvent neutral group 1 paraffinic base oil having a viscosity of about 600 SUS at 100 F, and 10.00 grams of PAO having a viscosity of 4 cSt at 100 C. Mixing without heat began using a planetary mixing paddle. After mixing for 5 minutes, 84.00 grams of calcium hydroxyapatite with a mean particle size below 5 microns was added and allowed to mix in for 30 minutes Then 28.40 grams of a primarily C12 alkylbenzene sulfonic acid was added. After 20 minutes, 75.80 grams of finely divided calcium carbonate with a mean particle size below 5 microns was added and allowed to mix in for 5 minutes. Then 18.00 grams of hexylene glycol and 45.0 grams water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Immediately, 2.80 grams glacial acetic acid was added followed by 28.40 grams of 12-hydroxystearic acid. Then 19.00 grams of a 75% solution of phosphoric acid in water was added. These three acids were the complexing acids for this batch. The mixture was then heated with an electric heating mantle while continuing to stir. When the grease reached 300 F, 27.80 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, 68.16 grams of the same paraffinic base oil was slowly added. When the temperature of the grease cooled to 200 F, 5.00 grams of a polyisobutylene polymer was added. Mixing continued until the grease reached a temperature of 170 F. A portion of the grease was then removed from the mixer and given three passes through a three-roll mill to achieve a final smooth homogenous texture. The grease had an unworked penetration of 233. The milled grease was returned to the mixer, and an additional 180.0 grams of the same paraffinic base oil was slowly added and allowed to mix into the grease for 30 minutes. The final grease was removed from the mixer and given three passes through the three-roll mill. The worked 60 strokes penetration of the grease was 279. The percent overbased oil-soluble calcium sulfonate in the final grease was 30.5%. The dropping point was 588 F.

Several aspects concerning this example should be noted. First, the calcium hydroxyapatite was added before the C12 sulfonic acid. In all previous examples where calcium hydroxyapatite was added, the C12 sulfonic acid was added before the calcium hydroxyapatite. The results of this batch show that the order in which these two components are added is not critical to the success of the invention. Subsequent examples will continue to show this. Second, the amount of calcium hydroxyapatite added in this batch combined with the minor amount of calcium hydroxide and/or calcium oxide present in the overbased calcium sulfonate was only enough to react with and neutralize about 64% of all the acids added including the C12 sulfonic acid. However, the added calcium carbonate was much more than what was required to react with and neutralize the remaining acids. Comparing the test results of this example to the previous Example 9 (which used the same ingredients and same method, except no calcium hydroxyapatite was added), it is clear that this embodiment of the invention provides an improvement in dropping point even though the same poor quality overbased oil-soluble calcium sulfonate was used in both greases.

Example 20

A calcium sulfonate complex grease according to another embodiment of present invention was made using the same poor quality overbased calcium sulfonate of Examples 9 and 19 wherein calcium hydroxyapatite and calcium carbonate were added before conversion. Also, 40% of the total amounts of 12-hydroxystearic acid and acetic acid were added before conversion. The grease was made as follows: 360.0 grams of the poor quality 400 TBN overbased oil-soluble calcium sulfonate was added to an open mixing vessel followed by 272.6 grams of a solvent neutral group 1 paraffinic base oil having a viscosity of about 600 SUS at 100 F, and 10.00 grams of PAO having a viscosity of 4 cSt at 100 C. Mixing without heat began using a planetary mixing paddle. After mixing for 5 minutes, 84.00 grams of calcium hydroxyapatite with a mean particle size below 5 microns was added and allowed to mix in for 30 minutes Then 28.40 grams of a primarily C12 alkylbenzene sulfonic acid was added. After 20 minutes, 1.12 grams of glacial acetic acid and 11.36 grams of 12-hydroxystearic acid were added and allowed to mix in for 10 minutes. Then 75.80 grams of finely divided calcium carbonate with a mean particle size below 5 microns was added and allowed to mix in for 5 minutes. Then 18.00 grams of hexylene glycol and 45.0 grams water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Immediately, 1.68 grams glacial acetic acid was added followed by 17.04 grams of 12-hydroxystearic acid. Then 19.00 grams of a 75% solution of phosphoric acid in water was added. These three acids were the complexing acids for this batch. The mixture was then heated with an electric heating mantle while continuing to stir. When the grease reached 300 F, 27.80 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 250 F, 68.16 grams of the same paraffinic base oil was slowly added. When the temperature of the grease cooled to 200 F, 5.00 grams of a polyisobutylene polymer was added. Mixing continued until the grease reached a temperature of 170 F. Because the grease appeared very heavy, an additional 102.2 grams of the same paraffinic base oil was slowly added and allowed to mix in for 30 minutes. A portion of the grease was then removed from the mixer and given three passes through a three-roll mill to achieve a final smooth homogenous texture. The grease had an unworked penetration of 235. The milled grease was returned to the mixer, and an additional 211.1 grams of the same paraffinic base oil was slowly added and allowed to mix into the grease for 40 minutes. The final grease was removed from the mixer and given three passes through the three-roll mill. The worked 60 strokes penetration of the grease was 298. The percent overbased oil-soluble calcium sulfonate in the final grease was 27.4%. The dropping point was 605 F.

The grease of Example 20 was also evaluated according to the Four Ball Extreme Pressure test ASTM D2596. The weld load was 620 kg. The amount of calcium hydroxyapatite added in this batch combined with the minor amount of calcium hydroxide and/or calcium oxide typically present in the overbased calcium sulfonate was only enough to react with and neutralize about 64% of all the acids added including the C12 sulfonic acid. However, the added calcium carbonate was much more than what was required to react with and neutralize the remaining acids.

Example 21

Another calcium sulfonate complex grease according to an embodiment of the invention was made using the same poor quality overbased oil-soluble calcium sulfonate. This grease was the same as the grease of the previous Example 20 except that 50% of the calcium carbonate was added before conversion. The remaining 50% calcium carbonate was added after the grease had been heated to about 390 F and then cooled below 300 F. Other aspects of making this grease were the same as example 20. The worked 60 strokes penetration of the grease was 283. The percent overbased oil-soluble calcium sulfonate in the final grease was 25.7%. The dropping point was 579 F. This grease was also evaluated according to the Four Ball Extreme Pressure test ASTM D2596. The weld load was 620 kg. The amount of calcium hydroxyapatite added in this batch combined with the minor amount of calcium hydroxide and/or calcium oxide present in the overbased calcium sulfonate was only enough to react with and neutralize about 64% of all the acids added including the C12 sulfonic acid. However, the calcium carbonate that was added at the beginning before conversion was much more than what was required to react with and neutralize the remaining acids.

Example 22

Another calcium sulfonate complex grease according to an embodiment of the invention was made using the same poor quality overbased oil-soluble calcium sulfonate. This grease was made similarly to the grease of Example 21 except that boric acid was added after conversion as a complexing acid. The grease was made as follows: 360.0 grams of the poor quality 400 TBN overbased oil-soluble calcium sulfonate was added to an open mixing vessel followed by 264.6 grams of a solvent neutral group 1 paraffinic base oil having a viscosity of about 600 SUS at 100 F, and 10.00 grams of PAO having a viscosity of 4 cSt at 100 C. Mixing without heat began using a planetary mixing paddle. After mixing for 5 minutes, 84.00 grams of calcium hydroxyapatite with a mean particle size below 5 microns was added and allowed to mix in for 30 minutes Then 28.40 grams of a primarily C12 alkylbenzene sulfonic acid was added. After 20 minutes, 1.12 grams of glacial acetic acid and 11.36 grams of 12-hydroxystearic acid were added and allowed to mix in for 10 minutes. Then 37.90 grams of finely divided calcium carbonate with a mean particle size below 5 microns was added and allowed to mix in for 5 minutes. Then 18.00 grams of hexylene glycol and 45.0 grams water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. The grease looked very heavy, so 82.52 grams of the same paraffinic base oil was slowly added. Immediately, 1.68 grams glacial acetic acid was added followed by 17.04 grams of 12-hydroxystearic acid. At this point, 10.00 grams of crystalline boric acid powder was dispersed in about 15 milliliters of water and added to the grease. Because the grease appeared very heavy, an additional 68.84 grams of the same paraffinic base oil was added. Then 19.00 grams of a 75% solution of phosphoric acid in water was added. These four acids were the complexing acids for this batch. The mixture was then heated with an electric heating mantle while continuing to stir. When the grease reached 300 F, 27.80 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease had cooled below 300 F, another 37.9 grams of calcium carbonate was added. When the grease cooled to 250 F, 142.8 grams of the same paraffinic base oil was slowly added. When the temperature of the grease cooled to 200 F, 5.00 grams of a polyisobutylene polymer was added. Mixing continued until the grease reached a temperature of 170 F. A portion of the grease was then removed from the mixer and given three passes through a three-roll mill to achieve a final smooth homogenous texture. The grease had an unworked penetration of 255. The milled grease was returned to the mixer, and an additional 120.4 grams of the same paraffinic base oil was slowly added and allowed to mix into the grease for 40 minutes. The final grease was removed from the mixer and given three passes through the three-roll mill. The worked 60 strokes penetration of the grease was 285. The percent overbased oil-soluble calcium sulfonate in the final grease was 26.7%. The dropping point was 618 F. This grease was also evaluated according to the Four Ball Extreme Pressure test ASTM D2596. The weld load was greater than 800 kg. The amount of calcium hydroxyapatite added in this batch combined with the minor amount of calcium hydroxide and/or calcium oxide present in the overbased calcium sulfonate was only enough to react with and neutralize about 50% of all the acids added including the C12 sulfonic acid. However, the added calcium carbonate was much more than what was required to react with and neutralize the remaining acids.

Example 23

Another calcium sulfonate complex grease according to an embodiment of the invention was made using the same poor quality overbased oil-soluble calcium sulfonate. This grease was made similarly to the grease of Example 22 except that the amount of boric acid was increased. Also, the amount of calcium carbonate added before conversion was increased in accordance to the increase in boric acid. The grease was made as follows: 360.0 grams of the poor quality 400 TBN overbased oil-soluble calcium sulfonate was added to an open mixing vessel followed by 237.9 grams of a solvent neutral group 1 paraffinic base oil having a viscosity of about 600 SUS at 100 F, and 10.00 grams of PAO having a viscosity of 4 cSt at 100 C. Mixing without heat began using a planetary mixing paddle. After mixing for 5 minutes, 84.00 grams of calcium hydroxyapatite with a mean particle size below 5 microns was added and allowed to mix in for 30 minutes Then 28.40 grams of a primarily C12 alkylbenzene sulfonic acid was added. After 20 minutes, 1.12 grams of glacial acetic acid and 11.36 grams of 12-hydroxystearic acid were added and allowed to mix in for 10 minutes. Then 57.3 grams of finely divided calcium carbonate with a mean particle size below 5 microns was added and allowed to mix in for 5 minutes. Then 18.00 grams of hexylene glycol and 45.0 grams water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. The grease looked very heavy so 59.48 grams of the same paraffinic base oil was slowly added. Immediately, 1.68 grams glacial acetic acid was added followed by 17.04 grams of 12-hydroxystearic acid. At this point, 24.00 grams of crystalline boric acid powder was dispersed in about 20 milliliters of water and added to the grease. Because the grease appeared very heavy, an additional 128.8 grams of the same paraffinic base oil was added. Then 19.00 grams of a 75% solution of phosphoric acid in water was added. These four acids were the complexing acids for this batch. The mixture was then heated with an electric heating mantle while continuing to stir. When the grease reached 300 F, 27.80 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease had cooled below 300 F, another 37.9 grams of calcium carbonate was added. When the temperature of the grease cooled to 200 F, 5.00 grams of a polyisobutylene polymer was added. Mixing continued until the grease reached a temperature of 170 F. A portion of the grease was then removed from the mixer and given three passes through a three-roll mill to achieve a final smooth homogenous texture. The grease had an unworked penetration of 245. The milled grease was returned to the mixer, and an additional 161.2 grams of the same paraffinic base oil was slowly added and allowed to mix into the grease for 40 minutes. The final grease was removed from the mixer and given three passes through the three-roll mill. The worked 60 strokes penetration of the grease was 275. The percent overbased oil-soluble calcium sulfonate in the final grease was 27.9%. The dropping point was 607 F.

The grease of Example 23 was also evaluated according to the Four Ball Extreme Pressure test ASTM D2596. The weld load was greater than 800 kg. The amount of calcium hydroxyapatite added in this batch combined with the minor amount of calcium hydroxide and/or calcium oxide from the overbased calcium sulfonate was only enough to react with and neutralize about 39% of all the acids added including the C12 sulfonic acid. However, the added calcium carbonate was much more than what was required to react with and neutralize the remaining acids.

Example 24

Another calcium sulfonate complex grease according to an embodiment of the invention was made using the same poor quality overbased oil-soluble calcium sulfonate. This grease was similar to the grease of Example 22 except for one change: half the calcium hydroxyapatite was replaced with a hydroxide equivalent amount of calcium hydroxide. The grease was made as follows: 360.0 grams of the poor quality 400 TBN overbased oil-soluble calcium sulfonate was added to an open mixing vessel followed by 295.76 grams of a solvent neutral group 1 paraffinic base oil having a viscosity of about 600 SUS at 100 F, and 10.00 grams of PAO having a viscosity of 4 cSt at 100 C. Mixing without heat began using a planetary mixing paddle. After mixing for 5 minutes, 42.00 grams of calcium hydroxyapatite with a mean particle size below 5 microns was added. This was followed by 3.10 grams of food grade purity calcium hydroxide having a mean particle size below 5 microns. After 30 minutes of mixing, 28.40 grams of a primarily C12 alkylbenzene sulfonic acid was added. After 20 minutes, 1.12 grams of glacial acetic acid and 11.36 grams of 12-hydroxystearic acid were added and allowed to mix in for 10 minutes. Then 37.90 grams of finely divided calcium carbonate with a mean particle size below 5 microns was added and allowed to mix in for 5 minutes. Then 18.00 grams of hexylene glycol and 45.0 grams water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. The grease looked very heavy so 73.94 grams of the same paraffinic base oil was slowly added. Immediately, 1.68 grams glacial acetic acid was added followed by 17.04 grams of 12-hydroxystearic acid. At this point, 10.00 grams of crystalline boric acid powder was dispersed in about 15 milliliters of water and added to the grease. Then 19.00 grams of a 75% solution of phosphoric acid in water was added. These four acids were the complexing acids for this batch. Because the grease appeared very heavy, an additional 110.9 grams of the same paraffinic base oil was added. The mixture was then heated with an electric heating mantle while continuing to stir. When the grease reached 300 F, 27.80 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease had cooled below 300 F, another 37.9 grams of calcium carbonate was added. When the temperature of the grease cooled to 200 F, 5.00 grams of a polyisobutylene polymer was added. Mixing continued until the grease reached a temperature of 170 F. A portion of the grease was then removed from the mixer and given three passes through a three-roll mill to achieve a final smooth homogenous texture. The grease had an unworked penetration of 235. The milled grease was returned to the mixer, and an additional 212.7 grams of the same paraffinic base oil was slowly added and allowed to mix into the grease for 30 minutes. The final grease was removed from the mixer and given three passes through the three-roll mill. The worked 60 strokes penetration of the grease was 291. The percent overbased oil-soluble calcium sulfonate in the final grease was 27.2%. The dropping point was 603 F.

The grease of Example 24 was also evaluated according to the Four Ball Extreme Pressure test ASTM D2596. The weld load was 800 kg. The amount of calcium hydroxyapatite and calcium hydroxide added in this batch combined with the minor amount of calcium hydroxide and/or calcium oxide from the overbased calcium sulfonate was only enough to react with and neutralize about 50% of all the acids added including the C12 sulfonic acid. However, the added calcium carbonate was much more than what was required to react with and neutralize the remaining acids.

Comparison of this batch with the greases of Examples 22 and 11, it is clear that the beneficial effects of pre-conversion added calcium hydroxyapatite are also evident when half of the calcium hydroxyapatite is replaced by a hydroxide equivalent amount of calcium hydroxide (compare Examples 22 and 24). However, if all the calcium hydroxyapatite is replaced by a hydroxide equivalent amount of calcium hydroxide, a much lower dropping point is obtained (Example 11). In other words, when using a poor quality overbased oil-soluble calcium sulfonate to make a calcium sulfonate complex grease, the beneficial improvement in dropping point caused by using calcium hydroxyapatite as the added sole hydroxide source is maintained if up to half of the calcium hydroxyapatite is replaced by a hydroxide equivalent amount of calcium hydroxide. However, if all the calcium hydroxyapatite is replaced by a hydroxide equivalent amount of calcium hydroxide, the dropping point improvements are lost. This result is unexpected based on the known prior art.

Example 24A

Another calcium sulfonate complex grease according to the present invention was made using the same poor quality overbased oil-soluble calcium sulfonate. This grease was made like the previous grease of Example 22 with on primary difference: 75% of the calcium hydroxyapatite was replaced with a hydroxide equivalent amount of calcium hydroxide.

The grease was made as follows: 360.0 grams of the poor quality 400 TBN overbased oil-soluble calcium sulfonate was added to an open mixing vessel followed by 311.28 grams of a solvent neutral group 1 paraffinic base oil having a viscosity of about 600 SUS at 100 F, and 10.00 grams of PAO having a viscosity of 4 cSt at 100 C. Mixing without heat began using a planetary mixing paddle. After mixing for 5 minutes, 21.00 grams of calcium hydroxyapatite with a mean particle size below 5 microns was added. This was followed by 4.70 grams of food grade purity calcium hydroxide having a mean particle size below 5 microns. After 30 minutes of mixing, 28.40 grams of a primarily C12 alkylbenzene sulfonic acid was added. After 20 minutes, 1.12 grams of glacial acetic acid and 11.36 grams of 12-hydroxystearic acid were added and allowed to mix in for 10 minutes. Then 37.90 grams of finely divided calcium carbonate with a mean particle size below 5 microns was added and allowed to mix in for 5 minutes. Then 18.00 grams of hexylene glycol and 45.0 grams water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. The grease looked very heavy so 77.82 grams of the same paraffinic base oil was slowly added. Immediately, 1.68 grams glacial acetic acid was added followed by 17.04 grams of 12-hydroxystearic acid. At this point, 10.00 grams of crystalline boric acid powder was dispersed in about 50 milliliters of hot water and added to the grease. Then 19.00 grams of a 75% solution of phosphoric acid in water was added. These four acids were the complexing acids for this batch. Because the grease appeared very heavy, an additional 116.73 grams of the same paraffinic base oil was added. The mixture was then heated with an electric heating mantle while continuing to stir. When the grease reached 300 F, 27.80 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease had cooled below 300 F, another 37.9 grams of calcium carbonate was added. When the temperature of the grease cooled to 200 F, 5.00 grams of a polyisobutylene polymer was added. Mixing continued until the grease reached a temperature of 170 F. A portion of the grease was then removed from the mixer and given three passes through a three-roll mill to achieve a final smooth homogenous texture. The grease had an unworked penetration of 253. The milled grease was returned to the mixer, and an additional 75.04 grams of the same paraffinic base oil was slowly added and allowed to mix into the grease for 30 minutes. The final grease was removed from the mixer and given three passes through the three-roll mill. The worked 60 strokes penetration of the grease was 275. The percent overbased oil-soluble calcium sulfonate in the final grease was 30.2%. The dropping point was greater than 650 F. This grease was also evaluated according to the Four Ball Extreme Pressure test ASTM D2596. The weld load was 620 kg. The amount of calcium hydroxyapatite and calcium hydroxide added in this batch combined with the minor amount of calcium hydroxide and/or calcium oxide from the overbased calcium sulfonate was only enough to react with and neutralize about 50% of all the acids added including the C12 sulfonic acid. However, the added calcium carbonate was much more than what was required to react with and neutralize the remaining acids.

Comparison of this batch with the previous Examples 11, 22, and indicates that beneficial effects of pre-conversion added calcium hydroxyapatite are also evident not only when half of the calcium hydroxyapatite is replaced by a hydroxide equivalent amount of calcium hydroxide (compare Example 22 and 24), but also when 75% of the calcium hydroxyapatite is replaced by a hydroxide equivalent amount of calcium hydroxide (compare Example 24 and 24A).

Example 25

Another calcium sulfonate complex grease according to an embodiment of the invention was made using the same poor quality overbased oil-soluble calcium sulfonate. This grease was made exactly like the previous grease of Example 24 except that all the calcium carbonate was added after the grease had been heated to 390 F and cooled to below 300 F. Unlike the grease of the previous Example 24, no calcium carbonate was added before conversion. The final grease had a worked 60 strokes penetration of 281. The percent overbased oil-soluble calcium sulfonate in the final grease was 27.0%. The dropping point was 623 F. This grease was also evaluated according to the Four Ball Extreme Pressure test ASTM D2596. The weld load was 800 kg.

This example shows that the beneficial effect of replacing half of the calcium hydroxyapatite with a hydroxide equivalent amount of calcium carbonate is not dependent on the presence of the added calcium carbonate. The C12 sulfonic acid, 12-hydroxystearic acid, acetic acid, and boric acid all were neutralized by the hydroxide basicity provided by the calcium hydroxyapatite, the added calcium hydroxide, and the minor amount of calcium hydroxide and/or calcium oxide present in the overbased oil-soluble calcium sulfonate. But the amount of this basicity was insufficient to also react with and neutralize the phosphoric acid. The only other neutralizing source in this example when the phosphoric acid was added was the dispersed calcium carbonate originally present in the overbased oil-soluble calcium sulfonate used to make this grease. About 18.4% of that very finely dispersed calcium carbonate was consumed during the neutralization of the phosphoric acid. The ultra-high surface area of the very fine dispersion of calcium carbonate from the calcium sulfonate is a primary source of thickening for all simple and complex calcium sulfonate greases. As such, one would expect that the consumption of almost 20% of that very finely dispersed calcium carbonate would adversely impact the thickener yield. However, the thickener yield in this embodiment was excellent (based on less than 30% overbased oil-soluble calcium sulfonate used). This example shows an unexpected advantage of the composition and method according to this embodiment of the invention.

Example 26

Another calcium sulfonate complex grease according to an embodiment of the present invention was made using the same poor quality overbased oil-soluble calcium sulfonate. This grease was made exactly like the previous grease of Example 25 except that all the 12-hydroxystearic acid was added before conversion instead of just 40% of the 12-hydroxystearic acid being added. The final grease had a worked 60 strokes penetration of 283. The percent overbased oil-soluble calcium sulfonate in the final grease was 28.1%. The dropping point was 643 F. This grease was also evaluated according to the Four Ball Extreme Pressure test ASTM D2596. The weld load was 800 kg. This example continues to show the constant benefit of replacing half of the calcium hydroxyapatite with a hydroxide equivalent amount of calcium hydroxide as the calcium containing base when making calcium sulfonate complex greases that utilize poor quality overbased oil soluble calcium sulfonate. As with the previous Example 25 grease, the C12 sulfonic acid, 12-hydroxystearic acid, acetic acid, and boric acid all were neutralized by the hydroxide basicity provided by the calcium hydroxyapatite, calcium hydroxide, and the minor amount of calcium hydroxide and/or calcium oxide from the overbased oil-soluble calcium sulfonate, but this basicity was insufficient to neutralize the phosphoric acid. The phosphoric acid was neutralized by the dispersed calcium carbonate present in the calcium sulfonate. About 18.4% of that very finely dispersed calcium carbonate was consumed during the neutralization of the phosphoric acid. Despite this, an excellent thickener yield was again obtained as evidenced by the low percentage of overbased oil-soluble calcium sulfonate in the final grease.

Examples 25 and 26 also demonstrate that, according to these embodiments of the invention, improved thickener yield and dropping point can be achieved by using calcium hydroxyapatite as a base source, even when the total basicity provided by the minor amount of calcium hydroxide and/or calcium oxide that may be present from the overbased oil-soluble calcium sulfonate and the sum of the added calcium hydroxyapatite and any added calcium hydroxide is insufficient to react with and neutralize the added acids. In such case, the unreacted portion of the added acids may be neutralized by a portion of the very finely dispersed calcium carbonate originating from the overbased oil-soluble calcium sulfonate without adversely impacting the quality of the resulting grease.

Further examples of embodiments according to the invention were prepared using "good" quality overbased oil-soluble calcium sulfonates.

Example 27

Another calcium sulfonate complex grease according to an embodiment of the present invention was made using the good quality overbased oil-soluble calcium sulfonate of Example 4. Like the grease of Example 22, boric acid was used as a complexing acid. Also, 40% of the 12-hydroxystearic acid was added before conversion and 50% of the calcium carbonate was added before conversion. The grease was made as follows: 360.0 grams of the good quality 400 TBN overbased oil-soluble calcium sulfonate was added to an open mixing vessel followed by 263.3 grams of a solvent neutral group 1 paraffinic base oil having a viscosity of about 600 SUS at 100 F, and 10.00 grams of PAO having a viscosity of 4 cSt at 100 C. Mixing without heat began using a planetary mixing paddle. After mixing for 5 minutes, 84.00 grams of calcium hydroxyapatite with a mean particle size below 5 microns was added and allowed to mix in for 30 minutes Then 36.00 grams of a primarily C12 alkylbenzene sulfonic acid was added. After 20 minutes, 11.36 grams of 12-hydroxystearic acid were added and allowed to mix in for 10 minutes. Then 47.60 grams of finely divided calcium carbonate with a mean particle size below 5 microns was added and allowed to mix in for 5 minutes. Then 18.00 grams of hexylene glycol and 45.0 grams water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. The grease looked heavy so 29.26 grams of the same paraffinic base oil was slowly added. Immediately, 17.04 grams of 12-hydroxystearic acid was added. At this point, 24.00 grams of crystalline boric acid powder was dispersed in about 50 milliliters of hot water and added to the grease. Then 19.00 grams of a 75% solution of phosphoric acid in water was added. Because the grease thickened, an additional 88.03 grams of the same paraffinic base oil was added. The mixture was then heated with an electric heating mantle while continuing to stir. When the grease reached 300 F, 27.80 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease had cooled below 300 F, another 47.6 grams of calcium carbonate was added. When the temperature of the grease cooled to 200 F, 5.00 grams of a polyisobutylene polymer was added. Mixing continued until the grease reached a temperature of 170 F. A portion of the grease was then removed from the mixer and given three passes through a three-roll mill to achieve a final smooth homogenous texture. The grease had an unworked penetration of 239. The milled grease was returned to the mixer, and an additional 141.1 grams of the same paraffinic base oil was slowly added and allowed to mix into the grease for 40 minutes. The final grease was removed from the mixer and given three passes through the three-roll mill. The worked 60 strokes penetration of the grease was 299. The percent overbased oil-soluble calcium sulfonate in the final grease was 29.3%. The dropping point was greater than 650 F. This grease was also evaluated according to the Four Ball Extreme Pressure test ASTM D2596. The weld load was 800 kg. The amount of calcium hydroxyapatite added in this batch was only enough to react with and neutralize about 48% of all the acids added including the C12 sulfonic acid. However, the added calcium carbonate was much more than what was required to react with and neutralize the remaining acids.

Example 28

Another calcium sulfonate complex grease according to an embodiment of the invention was made using the good quality overbased oil-soluble calcium sulfonate of Example 4. This grease was exactly the same as the grease of Example 27 except that all of the 12-hydroxystearic acid was added before conversion. The final grease had a worked 60 strokes penetration of 285. The percent overbased oil-soluble calcium sulfonate in the final grease was 33.3%. The dropping point was greater than 650 F. This grease was also evaluated according to the Four Ball Extreme Pressure test ASTM D2596. The weld load was 800 kg. The amount of calcium hydroxyapatite added in this batch was only enough to react with and neutralize about 48% of all the acids added including the C12 sulfonic acid. However, the added calcium carbonate was much more than what was required to react with and neutralize the remaining acids.

Example 29

Another calcium sulfonate complex grease according to an embodiment of the invention was made using the overbased oil-soluble calcium sulfonate of Example 5. This overbased calcium sulfonate had good quality with respect to dropping point, but its thickener yield was not as good as demonstrated by the 39.3% calcium sulfonate used in Example 5. The grease according to this example was made as follows: 360.0 grams of the poor quality 400 TBN overbased oil-soluble calcium sulfonate was added to an open mixing vessel followed by 250.4 grams of a solvent neutral group 1 paraffinic base oil having a viscosity of about 600 SUS at 100 F, and 10.00 grams of PAO having a viscosity of 4 cSt at 100 C. Mixing without heat began using a planetary mixing paddle. After mixing for 5 minutes, 84.00 grams of calcium hydroxyapatite with a mean particle size below 5 microns was added and allowed to mix in for 30 minutes Then 36.00 grams of a primarily C12 alkylbenzene sulfonic acid was added. After 20 minutes, 1.12 grams of glacial acetic acid and 11.36 grams of 12-hydroxystearic acid were added and allowed to mix in for 10 minutes. Then 47.6 grams of finely divided calcium carbonate with a mean particle size below 5 microns was added and allowed to mix in for 5 minutes. Then 18.00 grams of hexylene glycol and 45.0 grams water were added. The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Immediately, 1.68 grams glacial acetic acid was added followed by 17.04 grams of 12-hydroxystearic acid. At this point, 24.00 grams of crystalline boric acid powder was dispersed in about 50 milliliters of hot water and added to the grease. These three acids were the complexing acids for this batch. Because the grease appeared heavy, an additional 31.0 grams of the same paraffinic base oil was added. The mixture was then heated with an electric heating mantle while continuing to stir. When the grease reached 300 F, 27.80 grams of a styrene-isoprene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease had cooled below 300 F, another 47.6 grams of calcium carbonate was added. Because the grease appeared heavy, an additional 51.2 grams of the same paraffinic base oil was added. When the temperature of the grease cooled to 200 F, 5.00 grams of a polyisobutylene polymer was added. Mixing continued until the grease reached a temperature of 170 F. A portion of the grease was then removed from the mixer and given three passes through a three-roll mill to achieve a final smooth homogenous texture. The grease had an unworked penetration of 243. The milled grease was returned to the mixer, and an additional 67.7 grams of the same paraffinic base oil was slowly added and allowed to mix into the grease for 40 minutes. The final grease was removed from the mixer and given three passes through the three-roll mill. The worked 60 strokes penetration of the grease was 281. The percent overbased oil-soluble calcium sulfonate in the final grease was 33.0%. The dropping point was greater than 650 F. This grease was also evaluated according to the Four Ball Extreme Pressure test ASTM D2596. The weld load was 800 kg.

The amount of calcium hydroxyapatite added in this batch combined with the minor amount of calcium hydroxide and/or calcium oxide present in the overbased calcium sulfonate was only enough to react with and neutralize about 79% of all the acids added including the C12 sulfonic acid. However, the added calcium carbonate was much more than what was required to react with and neutralize the remaining acids. By comparison of this Example 29 grease to the grease of Example 5, in which no calcium hydroxyapatite was used, this embodiment of the invention significantly improved the thickener yield while maintaining the excellent dropping point. Thus the present invention not only consistently improves dropping points and thickener yield of calcium sulfonate complex greases when using poor dropping point quality overbased oil-soluble calcium sulfonates, it also improved the thickener yield when using overbased oil-soluble calcium sulfonates that have good dropping point properties but poor thickener yield properties Although the examples provided herein fall primarily in the NLGI No. 2 or No. 3 grade, with No. 2 grade being the mast preferred, it should be further understood that the scope of this present invention includes all NLGI consistency grades harder and softer than a No. 2 grade. However, for such greases according to the present invention that are not NLGI No. 2 grade, their properties should be consistent with what would have been obtained if more or less base oil had been used so as to provide a No. 2 grade product, as will be understood by those of ordinary skill in the art.

As used herein, the term "thickener yield" as it applies to the subject invention shall be the conventional meaning, namely, the concentration of the highly overbased oil-soluble calcium sulfonate required to provide a grease with a specific desired consistency as measured by the standard penetration tests ASTM D217 or D1403 commonly used in lubricating grease manufacturing. In like manner, as used herein the "dropping point" of a grease shall refer to the value obtained by using the standard dropping point test ASTM D2265 commonly used in lubricating grease manufacturing. As used herein, quantities of ingredients identified by percentages or parts are by weight of the final grease product, even though the particular ingredient (such as water) may not be present in the final grease or may not be present in the final grease in the quantity identified for addition as an ingredient. Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

I claim:

1. A calcium sulfonate grease composition comprising the following ingredients:

overbased oil-soluble calcium sulfonate in an amount greater than 0% but not exceeding 36% by weight of a final grease product made with the composition; and calcium hydroxyapatite having a formula of Ca5(PO4)3OH or mathematically equivalent formula with a melting point of around 1100° C. and wherein such mathematically equivalent formula is not a mixture of tricalcium phosphate and calcium hydroxide.

2. The calcium sulfonate grease composition according to claim 1 wherein the final grease product is an NGLI grade no. 000 grease.

3. The calcium sulfonate grease composition according to claim 1 wherein the final grease product is an NGLI grade no. 00 grease.

4. The calcium sulfonate grease composition according to claim 1 wherein the final grease product is an NGLI grade no. 0 grease.

5. The calcium sulfonate grease composition according to claim 1 wherein the final grease product is an NGLI grade no. 1 grease.

6. The calcium sulfonate grease composition according to claim 1 wherein the final grease product is an NGLI grade no. 2 grease.

7. The calcium sulfonate grease composition according to claim 1 wherein the final grease product is an NGLI grade no. 3 grease.

8. The calcium sulfonate grease composition according to claim 1 wherein the grease has dropping point of 575 F or higher.

9. The calcium sulfonate grease composition according to claim 1 further comprising the following ingredients: at least one converting agent and at least one complexing acid.

10. The calcium sulfonate grease composition according to claim 9 wherein the amount of calcium hydroxyapatite is stoichiometrically insufficient to neutralize all of the complexing acid or acids.

11. The calcium sulfonate grease composition according to claim 10 further comprising the following ingredients: one or more other basic calcium compounds.

12. The calcium sulfonate grease composition according to claim 11 wherein the total amount of the one or more other basic calcium compounds is stoichiometrically sufficient to neutralize the complexing acid not neutralized by the calcium hydroxyapatite.

13. The calcium sulfonate grease composition according to claim 11 wherein the total amount of the one or more other basic calcium compounds is stoichiometrically insufficient to neutralize the complexing acid not neutralized by the calcium hydroxyapatite.

14. The calcium sulfonate grease composition according to claim 11 wherein the other basic calcium compounds are calcium hydroxide, calcium oxide, added calcium carbonate or any combination thereof.

15. The calcium sulfonate complex grease composition according to claim 1 wherein calcium oxide and calcium hydroxide are not ingredients.

16. The calcium sulfonate grease composition according to claim 1 wherein the overbased oil-soluble calcium sulfonate is a poor quality calcium sulfonate.

17. A calcium sulfonate grease composition comprising the following ingredients:

overbased oil-soluble calcium sulfonate;

calcium hydroxyapatite having a formula of Ca5(PO4) 3OH or mathematically equivalent formula with a melting point of around 1100° C. and wherein such mathematically equivalent formula is not a mixture of tricalcium phosphate and calcium hydroxide.

18. The calcium sulfonate grease composition according to claim 17 wherein the final grease product is an NGLI grade no. 000 grease.

19. The calcium sulfonate grease composition according to claim 17 wherein the final grease product is an NGLI grade no. 00 grease.

20. The calcium sulfonate grease composition according to claim 17 wherein the final grease product is an NGLI grade no. 0 grease.

21. The calcium sulfonate grease composition according to claim 17 wherein the final grease product is an NGLI grade no. 1 grease.

22. The calcium sulfonate grease composition according to claim 17 wherein the final grease product is an NGLI grade no. 2 grease.

23. The calcium sulfonate grease composition according to claim 17 wherein the final grease product is an NGLI grade no. 3 grease.

* * * * *